US008314745B2

(12) United States Patent
Omuro

(10) Patent No.: US 8,314,745 B2
(45) Date of Patent: Nov. 20, 2012

(54) REFLECTOR ANTENNA, METHOD OF FEEDING SAME, AND COMMUNICATION SYSTEM

(75) Inventor: Norihiko Omuro, Tokyo (JP)

(73) Assignee: NEC Corporation, Tokyo (JP)

( * ) Notice: Subject to any disclaimer, the term of this patent is extended or adjusted under 35 U.S.C. 154(b) by 348 days.

(21) Appl. No.: 12/671,148

(22) PCT Filed: Jul. 29, 2008

(86) PCT No.: PCT/JP2008/063561

§ 371 (c)(1),
(2), (4) Date: Jan. 28, 2010

(87) PCT Pub. No.: WO2009/017106

PCT Pub. Date: Feb. 5, 2009

(65) Prior Publication Data

US 2010/0201595 A1 Aug. 12, 2010

(30) Foreign Application Priority Data

Jul. 30, 2007 (JP) ..... 2007-197420

(51) Int. Cl.
*H01Q 19/12* (2006.01)

(52) U.S. Cl. ..... 343/840; 343/781 R

(58) Field of Classification Search ..... 343/840, 343/781 R, 779
See application file for complete search history.

(56) References Cited

U.S. PATENT DOCUMENTS

| | | | | |
|---|---|---|---|---|
| 4,412,222 | A | 10/1983 | Mohring | |
| 5,448,254 | A | 9/1995 | Schneeman et al. | |
| 5,554,998 | A * | 9/1996 | Sherwood et al. | 343/881 |
| 5,905,474 | A * | 5/1999 | Ngai et al. | 343/840 |
| 7,030,831 | B2 * | 4/2006 | Nilsson | 343/840 |
| 2004/0164920 | A1 | 8/2004 | Nilsson | |

FOREIGN PATENT DOCUMENTS

| | | |
|---|---|---|
| JP | 55-159605 | 11/1980 |
| JP | 01-135808 | 9/1989 |
| JP | 10-051231 | 2/1998 |
| JP | 2004-153863 | 5/2004 |

OTHER PUBLICATIONS

International Search Report, PCT/JP2008/063561, Nov. 11, 2008.
Chinese Official Action—200880100894.4—Jul. 16, 2012.

* cited by examiner

*Primary Examiner* — Hoang V Nguyen
(74) *Attorney, Agent, or Firm* — Young & Thompson

(57) ABSTRACT

A reflector antenna includes a reflector, a primary radiator, an arm, and a feed unit (a coaxial cable and a coaxial connector). The reflector has a reflecting surface for reflecting a radio wave, and the reflecting surface is shaped as a paraboloid of revolution. The primary radiator is arranged on a focus side of the reflector, and radiates a radio wave from the focus side toward the reflecting surface. The arm is arranged to extend from the reflecting surface side to the focus side of the reflector, and supports the primary radiator so as to be rotatable with respect to the reflector. The feed unit feeds the primary radiator via the arm so that the direction of the arm and the direction of polarization of the radio wave radiated from the primary radiator are perpendicular to each other.

20 Claims, 3 Drawing Sheets

11a
11
11b
r
1
2
3
3a
4
Rd
Rt
Ax
101
102
CS
h
D1
D2
Sd1
P1
P2
o
E 11a
11
11b
r
3
3a
4
1
2
Rd
Rt
Ax
101
102
CS
h
D4
D3
Ax
Rt
Sd2
P4
P3
o
E
-r

REFLECTOR ANTENNA, METHOD OF FEEDING SAME, AND COMMUNICATION SYSTEM

TECHNICAL FIELD

The present invention relates to a reflector antenna, a method of feeding the same, and a communication system. In particular, the present invention relates to a reflector antenna that radiates a radio wave when its primary radiator arranged on the focus side of its reflector is coaxially fed, a method of feeding the same, and a communication system.

BACKGROUND ART

Conventionally known reflector antennas for use in microwave and millimeter wave communication systems include ones intended for coaxial feed. A related technology on such a reflector antenna for coaxial feed will be described with reference to FIG. 3.

FIGS. 3A and 3B illustrate a reflector antenna which includes a reflector 11. The reflector 11 has a circular antenna aperture (antenna opening) 11*a* with a radius of r, and a reflecting surface (reflector surface) 11*b* that reflects radio waves. The reflecting surface 11*b* is curved to a paraboloid of revolution (hereinafter, paraboloid). A primary radiator 1 that radiates a radio wave Rd toward the reflecting surface 11*b* is arranged on the focus side of the paraboloid of the reflector 11. The primary radiator 1 is supported by a primary radiator support arm (hereinafter, arm) 2 so as to be rotatable about the rotation axis Ax of the paraboloid of the reflector 11. The arm 2 is arranged to extend from the vertex side to the focus side of the reflecting surface 11*b* so as to circumvent the rotation axis Ax of the paraboloid of the reflector 11. A feed unit is installed in the arm 2. The feed unit includes a coaxial cable 3 that feeds the primary radiator 1, and a coaxial connector 4 that connects the coaxial cable 3 to the primary radiator 1.

With the reflector antenna of the foregoing configuration, the coaxial cable 3 arranged in the arm 2 feeds the primary radiator 1 through the coaxial connector 4. The primary radiator 1 radiates a vertically- or horizontally-polarized radio wave Rd toward the reflecting surface 11*b* of the reflector 11. The radiated wave Rd is reflected by the reflecting surface 11*b* and emitted to the outside through the antenna aperture 11*a*. The vertical polarization and horizontal polarization of the radiated wave Rd are switched by rotating the arm 2 along with the coaxial cable 3 and the coaxial connector 4, about the rotation axis Ax of the paraboloid by 90° with respect to the reflector 11 (see the direction of rotation Rt in the diagram).

The example of FIG. 3 illustrates the case where a vertically-polarized radio wave Rd (the direction of polarization D11) is radiated. In such a case, the arm 2 is rotated about the rotation axis Ax with respect to the reflector 11 so that the direction of feeding D12 from the coaxial cable 3 to the primary radiator 1 through the coaxial connector 4 becomes parallel to the vertical plane (plane parallel to a vertical axis that passes the rotation axis Ax in FIG. 3B). To radiate a horizontally-polarized radio wave Rd, on the other hand, the arm 2 is rotated about the rotation axis Ax with respect to the reflector 11 so that the direction of feeding from the coaxial cable 3 to the primary radiator 1 through the coaxial connector 4 becomes parallel to the horizontal plane (plane parallel to a horizontal axis h that passes the rotation axis Ax in FIG. 3B). The rotating operation of the arm 2 is performed by hand, for example.

The foregoing reflector antenna is coaxially fed through the coaxial cable that is arranged in the arm. In another known configuration, the arm itself may be made of a waveguide so that the feeding is conducted by the waveguide. PTL 1 describes a reflector antenna or antenna apparatus intended for such waveguide feed. In the antenna apparatus, a bent feeder waveguide for feeding a primary radiator is arranged at 45° with respect to the horizontal direction so as to reduce the polarization characteristic of the decrease in gain due to the blocking of the feeder waveguide.

{Citation List}

{Patent Literature}

{PTL 1} JP-U-01-135808

SUMMARY OF INVENTION

Technical Problem

Take the reflector antenna for coaxial feed according to the foregoing related technology for example. As illustrated in FIG. 3B, when the radio wave Rd vertically polarized along the direction of polarization D11 is radiated from the primary radiator 1 with the arm 2 situated in the vertical plane, some of the radiated wave Rd is blocked by the arm 2. This forms an area of shadow Sd11 of the arm 2 on the reflecting surface (reflector surface) 11*b*. As illustrated in FIG. 3C, the area of shadow Sd11 of the arm 2 is expressed as a distribution P11 in the diagram when the irradiation distribution that shows the field intensity E of the radiated wave Rd on the antenna aperture 11*a* is projected on the horizontal axis h ($-r \leqq h \leqq r$). The blocking distribution P11 is subtracted from the unblocked original irradiation distribution P12, and disturbs the radiation pattern in the horizontal plane accordingly. The blocking distribution has a significant impact on paraxial cross-polarization characteristics in particular.

With horizontal polarization, the blocking distribution due to the area of shadow of the arm 2 that is situated in the horizontal plane is small in amount even if accumulated on the horizontal axis h. The influence on the irradiation distribution on the antenna aperture 11*a* is thus small. With vertical polarization, on the other hand, the blocking distribution P1 due to the area of shadow Sd11 of the arm 2 that is situated in the vertical plane is greater in amount when accumulated on the horizontal axis h as illustrated in FIG. 3C. The influence on the irradiation distribution on the antenna aperture 11*a* is thus high. The influence becomes particularly significant in the cases of communication systems for P-P (Point to Point) communications and the like where the radiation pattern in the horizontal plane is of high importance. The reason is that the radiation pattern in the horizontal plane is determined by the irradiation distribution on the antenna aperture 11*a*, projected on the horizontal axis as illustrated in FIG. 3C.

Meanwhile, the reflector antenna of the foregoing PTL 1 is intended for waveguide feed, and thus takes no account of the influence that the blocking distribution due to the area of shadow of the arm has on the irradiation distribution on the antenna aperture in the foregoing reflector antenna for coaxial feed.

The present invention has been achieved in view of the foregoing problems. It is thus an object of the present invention to provide a reflector antenna intended for coaxial feed, a method of feeding the same, and a communication system, the reflector antenna being capable of reducing the blocking distribution due to the area of shadow of the arm in the irradiation distribution on the antenna aperture, thereby reducing disturbance to the radiation pattern in the horizontal plane and suppressing the impact of cross-polarization characteristics.

Solution to Problem

To achieve the foregoing object, a reflector antenna according to the present invention includes: a reflector that has a reflecting surface for reflecting a radio wave, the reflecting surface being shaped as a paraboloid of revolution; a primary radiator that is arranged on a focus side of the reflector, and radiates a radio wave from the focus side toward the reflecting surface; an arm that is arranged to extend from the reflecting surface side to the focus side of the reflector, and supports the primary radiator so as to be rotatable with respect to the reflector; and a feed unit that feeds the primary radiator via the arm so that the direction of the arm and the direction of polarization of the radio wave radiated from the primary radiator are perpendicular to each other.

A method of feeding a reflector antenna according to the present invention includes feeding a primary radiator via an arm so that the direction of the arm and the direction of polarization of a radio wave radiated from the primary radiator are perpendicular to each other, the primary radiator being arranged on a focus side of a reflector, the arm supporting the primary reflector.

Advantageous Effects of Invention

According to the present invention, the primary radiator is fed via the arm so that the direction of the arm supporting the primary radiator and the direction of polarization of the radio wave radiated from the primary radiator are perpendicular to each other. This can reduce the blocking distribution due to the area of shadow of the arm in the irradiation distribution on the antenna aperture, thereby reducing disturbance to the radiation pattern in the horizontal plane and suppressing the influence of cross-polarization characteristics.

REFERENCE SIGNS LIST

Figures 1A, 1B, 1C:
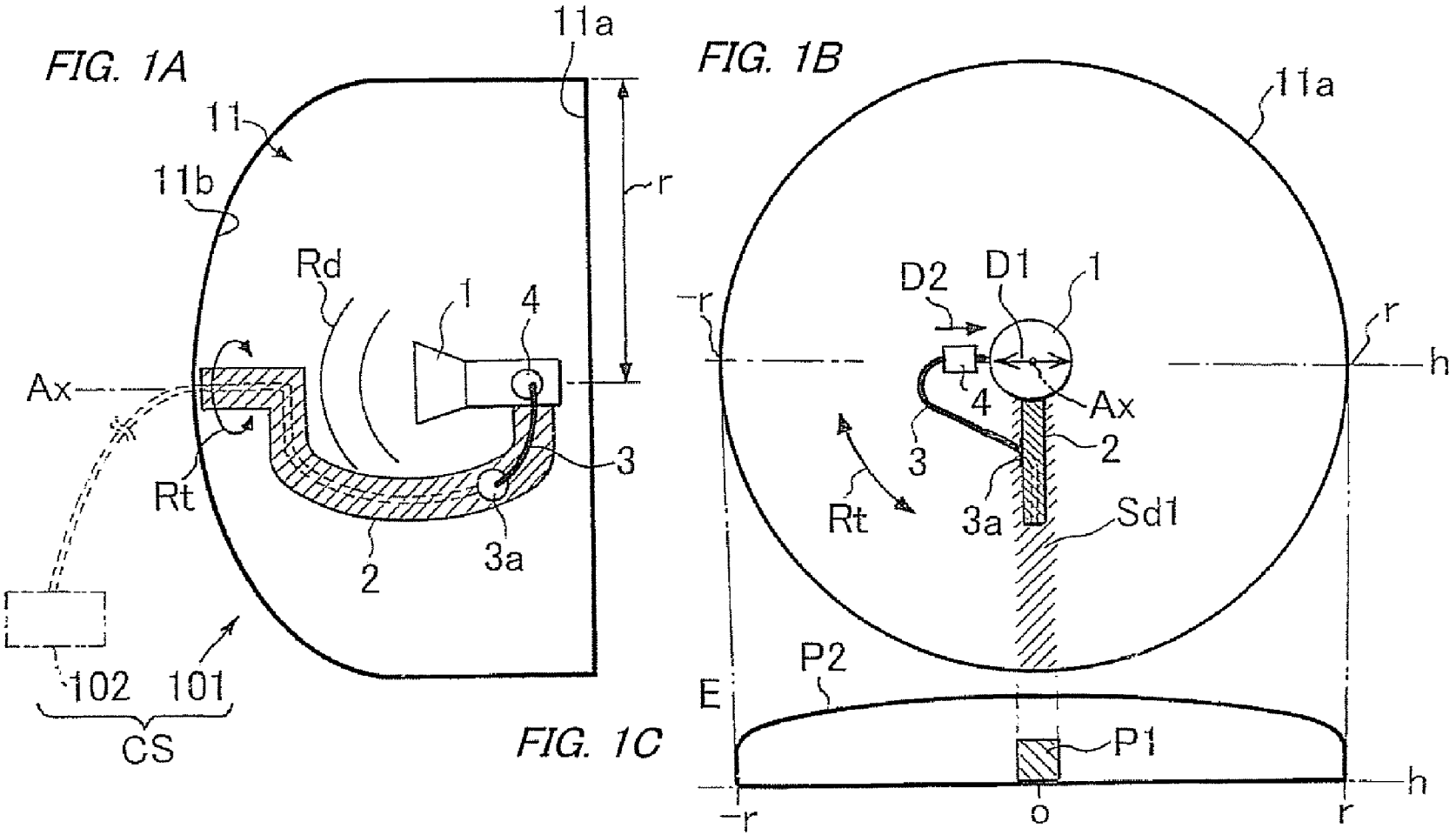
FIG. 1A is a side view of a reflector antenna according to an exemplary embodiment of the present invention for the case of radiating a horizontally-polarized radio wave.
FIG. 1B is a front view of the reflector antenna on the antenna aperture side.
FIG. 1C is a graph illustrating an irradiation distribution on the antenna aperture, projected on a horizontal axis.

1: primary radiator
2: arm (primary radiator support arm)
3: coaxial cable
4: coaxial connector
11: reflector

DESCRIPTION OF EMBODIMENTS

Next, an exemplary embodiment of the reflector antenna, the method of feeding the same, and the communication system according to the present invention will be described in detail with reference to the drawings.

FIGS. 1 and 2 illustrate a communication system CS according to the exemplary embodiment. The communication system CS is applicable to P-P communications, for example, and includes a reflector antenna 101 and a transmitter 102 which is connected to the reflector antenna 101.

For example, using high-frequency circuits mounted therein, the transmitter 102 modulates the baseband signal of data to be transmitted into an IF (Intermediate Frequency) signal by a predetermined modulation method, frequency-converts the IF signal into an RF (Radio Frequency) signal, amplifies the RF signal in power, and supplies the resultant to the reflector antenna 101. Note that the transmitter 102 may be of any configuration as long as it can be connected to the reflector antenna 101.

In FIGS. 1 and 2, the reflector antenna 101 includes a reflector 11. The reflector 11 has a circular antenna aperture (antenna opening) 11*a* with a radius of r, and a reflecting surface (reflector surface) 11*b* that reflects radio waves. The reflecting surface 11*b* is curved to a paraboloid of revolution (hereinafter, paraboloid). A primary radiator 1 that radiates a radio wave Rd toward the reflecting surface 11*b* is arranged on the focus side of the paraboloid of the reflector 11. The primary radiator 1 is supported by an arm (primary radiator support arm) 2 so as to be rotatable about the rotation axis Ax of the paraboloid of the reflector 11. The arm 2 is arranged to extend from the vertex side to the focus side of the reflecting surface 11*b* so as to circumvent the rotation axis Ax of the paraboloid of the reflector 11. A feed unit is attached to the arm 2.

Figures 2A, 2B, 2C:
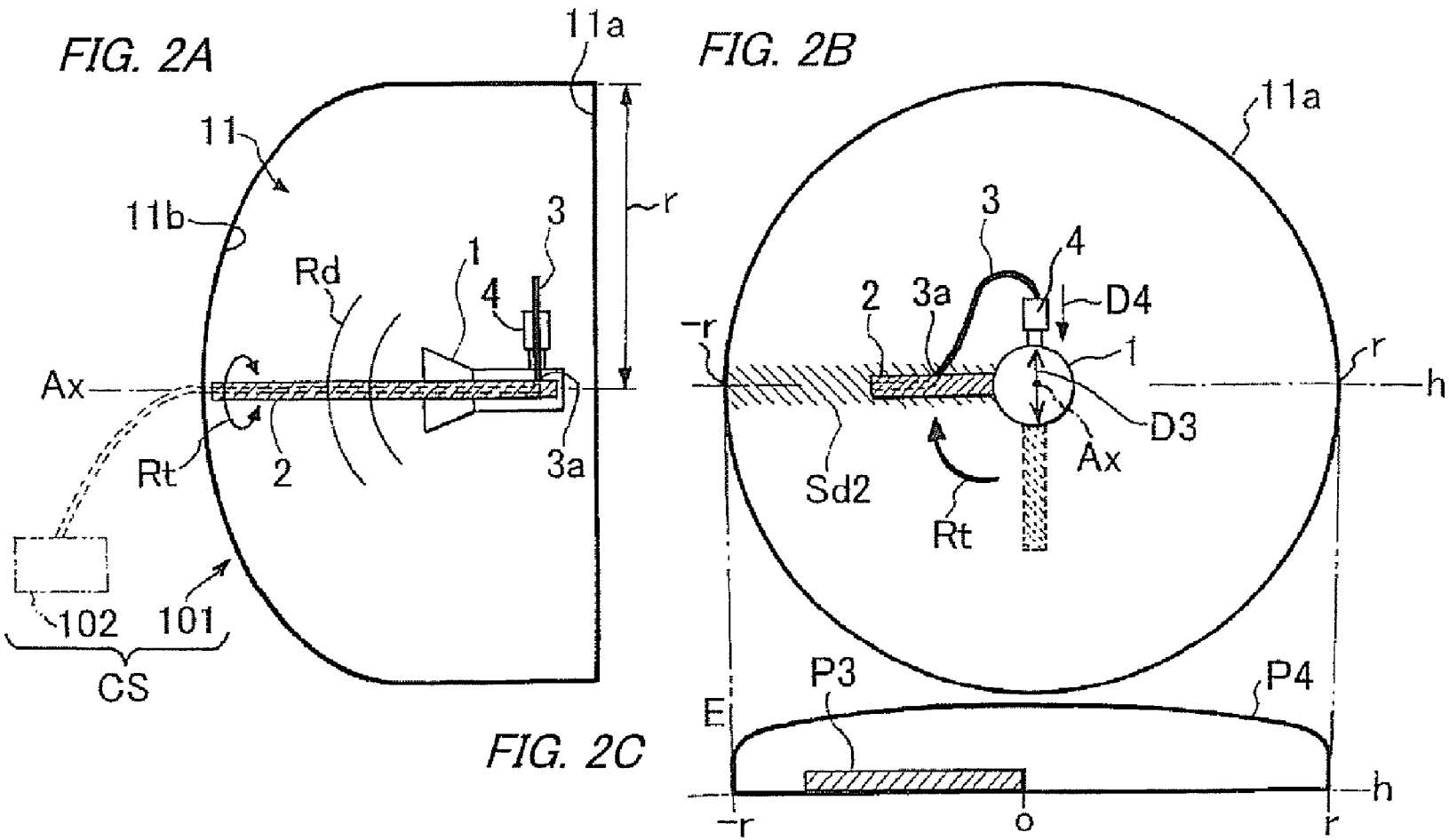
FIG. 2A is a side view of the reflector antenna of FIG. 1 for the case of radiating a vertically-polarized radio wave.
FIG. 2B is a front view of the reflector antenna on the antenna aperture side.
FIG. 2C is a graph illustrating an irradiation distribution on the antenna aperture, projected on a horizontal axis.

The feed unit feeds the primary radiator 1 via the arm 2 so that the direction of the arm 2 and the direction of polarization of the radio wave radiated from the primary radiator 1 are perpendicular to each other. When the arm 2 is situated in parallel with a vertical plane (plane parallel to a vertical axis that passes the rotation axis Ax in FIG. 1B) as illustrated in FIG. 1, the feed unit feeds the primary radiator 1 via the arm 2 along a direction D2 perpendicular to the vertical plane (a direction parallel to a horizontal axis h that passes the rotation axis Ax in FIG. 1B) so that a horizontally-polarized radio wave (the direction of polarization D1) is radiated from the primary radiator 1. When the arm 2 is situated in parallel with a horizontal plane (plane parallel to a horizontal axis h that passes the rotation axis Ax in FIG. 2B) as illustrated in FIG. 2, the feed unit feeds the primary radiator 1 via the arm 2 along a direction D4 perpendicular to the horizontal plane (a direction parallel to a vertical axis that passes the rotation axis Ax in FIG. 2B) so that a vertically-polarized radio wave (the direction of polarization D3) is radiated from the primary radiator 1.

In the exemplary embodiment, the feed unit includes a coaxial cable 3 that feeds the primary radiator 1 with electric power from the transmitter 102, and a coaxial connector 4 that connects the coaxial cable 3 to the primary radiator 1. The coaxial connector 4 connects the coaxial cable 3 to the primary radiator 1 so that the direction of feeding from the coaxial cable 3 to the primary radiator 1 and the direction of the arm 2 are at right angles to each other.

In the example of FIGS. 1 and 2, the coaxial connector 4 is attached to a side surface of the primary radiator 1 with a right angle to the direction of the arm 2. An opening 3*a* is formed in a predetermined position in an end portion of the arm 2 on the side of the primary radiator 1. The coaxial cable 3 is led out of the arm 2 through the opening 3*a*, and the end of the cable is connected to the coaxial connector 4. The coaxial connector 4 may be attached to any position of the primary radiator 1 as long as the direction of feeding to the primary radiator 1 and the direction of the arm 2 are at right angles to each other. While the coaxial cable 3 is arranged so that it is led out of the arm 2 through the opening 3*a*, the configuration is not limited thereto. The coaxial cable 3 may be attached to the external surface of the arm 2 all the way, in which case the opening 3*a* can be omitted.

Next, the operation of the exemplary embodiment will be described.

Description will initially be given of the case illustrated in FIG. 1, where a horizontally-polarized radio wave (the direction of polarization D1) is radiated. In such a case, as illustrated in FIGS. 1A and 1B, the arm 2 is rotated about the rotation axis A with respect to the reflector 11 (see the direction of rotation Rt in the diagram) into the position in the vertical plane (plane parallel to the vertical axis that passes the rotation axis Ax in FIG. 1B) so that the direction of feeding D2 from the coaxial cable 3 to the primary radiator 1 through the coaxial connector 4 becomes parallel to the horizontal plane (plane parallel to the horizontal axis h that passes the rotation axis Ax in FIG. 1B). The rotating operation of the arm 2 is performed by hand, for example, whereas it may be controlled automatically. For automatic control, the rotating shaft of a rotating mechanism such as a motor may be connected to the shaft of the arm 2, and the operation of the rotating mechanism may be controlled by a drive control signal from the transmitter 102.

Next, via the arm 2 situated in the vertical plane, the primary radiator 1 is fed from the coaxial cable 3 through the coaxial connector 4 along the direction D2 perpendicular to the direction of the arm 2. As a result, a radio wave Rd horizontally polarized in the direction of polarization D1 is radiated from the primary radiator 1 toward the reflecting surface 11*b* of the reflector 11. The horizontally-polarized radiated wave Rd is reflected by the reflecting surface 11*b* and emitted to the outside through the antenna aperture 11*a*.

When the radio wave Rd horizontally polarized along the direction of polarization D1 in the diagram is radiated from the primary radiator 1 with the arm 2 situated in the vertical plane, some of the radiated wave Rd is blocked by the arm 2. This forms an area of shadow Sd1 of the arm 2 on the reflecting surface (reflector surface) 11*b*. As illustrated in FIG. 1C, the area of shadow Sd1 of the arm 2 is expressed as a distribution P1 in the diagram when the irradiation distribution that shows the field intensity E of the radiated wave Rd on the antenna aperture 11*a* is projected on the horizontal axis h ($-r \leqq h \leqq r$). The blocking distribution P1 is subtracted from the unblocked original irradiation distribution P2, and disturbs the radiation pattern in the horizontal plane accordingly.

Next, description will be given of the case illustrated in FIG. 2, where a vertically-polarized radio wave (the direction of polarization D3) is radiated. In such a case, the arm 2 lying in the vertical plane is rotated into the position in the horizontal plane (plane parallel to the horizontal axis h that passes the rotation axis Ax in FIG. 2B) by 90° (see the direction of rotation Rt in the diagram) so that the direction of feeding from the coaxial cable 3 to the primary radiator 1 through the coaxial connector 4 becomes parallel to the vertical plane (plane parallel to the vertical axis that passes the rotation axis Ax in FIG. 2B).

Next, via the arm 2 situated in the horizontal plane, the primary radiator 1 is fed from the coaxial cable 3 through the coaxial connector 4 along the direction D4 perpendicular to the direction of the arm 2. Consequently, a radio wave Rd vertically polarized in the direction of polarization D3 is radiated from the primary radiator 1 toward the reflecting surface 11*b* of the reflector 11. The vertically-polarized radiated wave Rd is reflected by the reflecting surface 11*b* and emitted to the outside through the antenna aperture 11*a*.

When the radio wave Rd horizontally polarized along the direction of polarization D3 in the diagram is radiated from the primary radiator 1 with the arm 2 situated in the horizontally plane, some of the radiated wave Rd is blocked by the arm 2. This forms an area of shadow Sd2 of the arm 2 on the reflecting surface (reflector surface) 11*b*. As illustrated in FIG. 2C, the area of shadow Sd2 of the arm 2 is expressed as a distribution P3 in the diagram when the irradiation distribution that shows the field intensity E of the radiated wave Rd on the antenna aperture 11*a* is projected on the horizontal axis h ($-r \leqq h \leqq r$). The blocking distribution P3 is subtracted from the unblocked original irradiation distribution P4, and disturbs the radiation pattern in the horizontal plane accordingly.

With vertical polarization, as illustrated in FIG. 2C, the area of shadow of the arm 2 projected on the horizontal axis h is lighter than with horizontal polarization illustrated in FIG. 1C. The area of shadow thus has not much impact on the radiation pattern of the radio wave. With horizontal polarization, as illustrated in FIG. 1C, the arm 2 forms a band of shadow in the lower half area below the center of the antenna aperture 11*a* in the diagram as with the vertical polarization according to the foregoing related technology of FIG. 3. This makes the amount of shadow accumulated on the horizontal axis h greater as compared to the case of vertical polarization illustrated in FIG. 2C.

Let us examine the polarization characteristic. If the direction of polarization D11 is parallel to the direction of the arm 2 as in the foregoing related technology of FIG. 3, the radio wave is prone to be reflected. If, on the other hand, the direction of polarization D1 is perpendicular to the direction of the arm 2, the presence of the arm 2 has less impact.

Figures 3A, 3B, 3C:
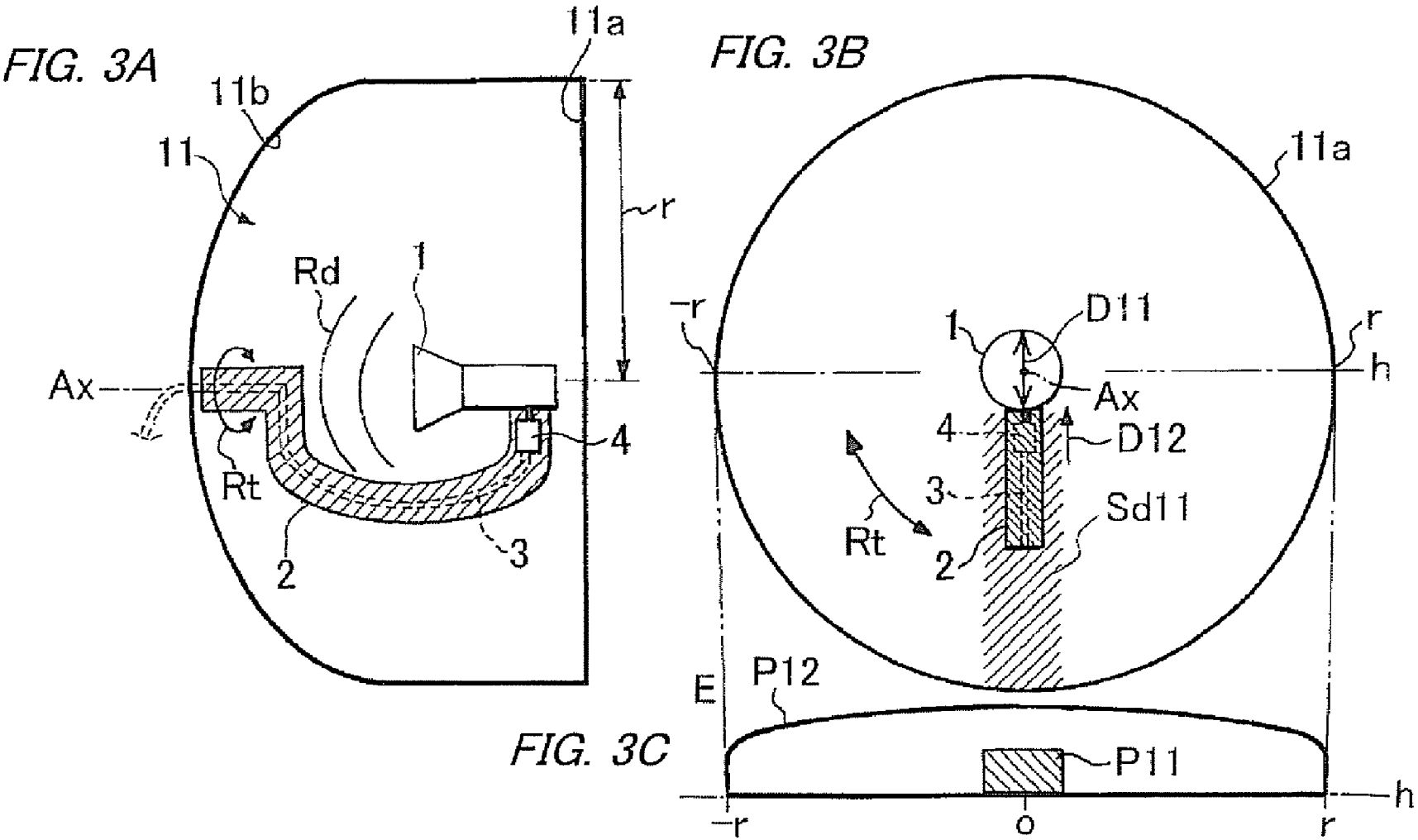
FIG. 3A is a side view of a reflector antenna according to the related technology for the case of radiating a vertically-polarized radio wave.
FIG. 3B is a front view of the reflector antenna on the antenna aperture side.
FIG. 3C is a graph illustrating an irradiation distribution on the antenna aperture, projected on a horizontal axis.

Considering that the influence on the irradiation distribution projected on the horizontal axis h increases when the arm 2 is situated vertically, the exemplary embodiment thus employs the feed unit of such a structure that can radiate a horizontally-polarized radio wave Rd as illustrated in FIG. 1, instead of radiating a vertically-polarized radio wave Rd as in the related technology of FIG. 3, in order to minimize the influence of the arm 2. More specifically, in the exemplary embodiment, the feed unit is configured so that the coaxial cable 3 makes a detour to shift the direction of feeding by 90° with respect to the direction of the arm 2, whereby the direction of the arm 2 and the direction of feeding from the coaxial connector 4 are put at right angles to each other.

Consequently, according to the exemplary embodiment, the band of shadow of the arm 2 appearing on the reflecting surface (reflector surface) 11*b* of the reflector 11 has a narrower width than with the related technology of FIG. 3. This reduces the blocking distribution due to the shadow of the arm 2 accordingly. According to the exemplary embodiment, it is therefore possible to achieve a reflector antenna that has an irradiation distribution closer to the unblocked original distribution. Such an effect becomes particularly significant in the cases of P-P communications where the radiation pattern in the horizontal plane is of high importance. The reason is that the radiation pattern in the horizontal plane is determined by the irradiation distribution on the antenna aperture, projected on the horizontal axis.

Up to this point, the present invention has been described with reference to the foregoing exemplary embodiment. However, the present invention is not limited to the exemplary embodiment. The configuration and details of the present invention are subject to various modifications understandable to those skilled in the art within the scope of the invention.

This application is based upon and claims the benefit of priority from prior Japanese Patent Application No. 2007-197420, filed Jul. 30, 2007, the entire contents of which are incorporated herein.

{Industrial Applicability}

The present invention is applicable to a reflector antenna intended for coaxial feed, a method of feeding the same, and a communication system that uses the reflector antenna.

The invention claimed is:

1. A reflector antenna comprising:

a reflector that has a reflecting surface for reflecting a radio wave, the reflecting surface being shaped as a paraboloid of revolution;

a primary radiator that is arranged on a focus side of the reflector, and radiates a radio wave from the focus side toward the reflecting surface;

an arm that is arranged to extend from the reflecting surface side to the focus side of the reflector, and supports the primary radiator so as to be rotatable with respect to the reflector; and a feed unit that feeds the primary radiator via the arm so that the direction of the arm and the direction of polarization of the radio wave radiated from the primary radiator are perpendicular to each other.

2. The reflector antenna according to claim 1, wherein when the direction of the arm is parallel to a vertical plane, the feed unit feeds the primary radiator via the arm along a direction perpendicular to the vertical plane so that a horizontally-polarized radio wave is radiated from the primary radiator.

3. The reflector antenna according to claim 2, wherein when the direction of the arm is parallel to a horizontal plane, the feed unit feeds the primary radiator via the arm along a direction perpendicular to the horizontal plane so that a vertically-polarized radio wave is radiated from the primary radiator.

4. The reflector antenna according to claim 2, wherein the feed unit includes:

a coaxial cable that feeds the primary radiator via the arm; and a coaxial connector that connects the coaxial cable to the primary radiator so that the direction of feeding from the coaxial cable to the primary radiator and the direction of the arm are at right angles to each other.

5. A communication system comprising:

the reflector antenna according to claim 2; and a transmitter that is connected to the reflector antenna.

6. The reflector antenna according to claim 1, wherein when the direction of the arm is parallel to a horizontal plane, the feed unit feeds the primary radiator via the arm along a direction perpendicular to the horizontal plane so that a vertically-polarized radio wave is radiated from the primary radiator.

7. The reflector antenna according to claim 6, wherein the feed unit includes:

a coaxial cable that feeds the primary radiator via the arm; and a coaxial connector that connects the coaxial cable to the primary radiator so that the direction of feeding from the coaxial cable to the primary radiator and the direction of the arm are at right angles to each other.

8. A communication system comprising:

the reflector antenna according to claim 6; and a transmitter that is connected to the reflector antenna.

9. The reflector antenna according to claim 1, wherein the feed unit includes:

a coaxial cable that feeds the primary radiator via the arm; and a coaxial connector that connects the coaxial cable to the primary radiator so that the direction of feeding from the coaxial cable to the primary radiator and the direction of the arm are at right angles to each other.

10. A communication system comprising:

the reflector antenna according to claim 9; and a transmitter that is connected to the reflector antenna.

11. The reflector antenna according to claim 9, wherein, an opening is formed in a predetermined position in an end portion of the arm on a side of the primary radiator, the coaxial cable is led out of the arm through the opening and connected to the coaxial connector, and the coaxial connector is attached to the primary radiator with a right angle to the direction of the arm.

12. A communication system comprising:

the reflector antenna according to claim 1; and a transmitter that is connected to the reflector antenna.

13. A method of feeding a reflector antenna, comprising feeding a primary radiator via an arm so that the direction of the arm and the direction of polarization of a radio wave radiated from the primary radiator are perpendicular to each other, the primary radiator being arranged on a focus side of a reflector, the arm supporting the primary reflector.

14. The method of feeding a reflector antenna according to claim 13, wherein when the direction of the arm is parallel to a vertical plane, the primary radiator is fed via the arm along a direction perpendicular to the vertical plane so that a horizontally-polarized radio wave is radiated from the primary radiator.

15. The method of feeding a reflector antenna according to claim 14, wherein when the direction of the arm is parallel to a horizontal plane, the primary radiator is fed via the arm along a direction perpendicular to the horizontal plane so that a vertically-polarized radio wave is radiated from the primary radiator.

16. The method of feeding a reflector antenna according to claim 13, wherein when the direction of the arm is parallel to a horizontal plane, the primary radiator is fed via the arm along a direction perpendicular to the horizontal plane so that a vertically-polarized radio wave is radiated from the primary radiator.

17. The method of feeding a reflector antenna according to claim 13, wherein:

a coaxial cable is attached to the arm;

the coaxial cable is connected to the primary radiator by a coaxial connector so that the direction of feeding from the coaxial cable to the primary radiator and the direction of the arm are at right angles to each other; and the primary radiator is fed by the coaxial cable through the coaxial connector along a direction at a right angle to the direction of the arm.

18. The method of feeding a reflector antenna according to claim 17, wherein, the coaxial cable is attached to the arm such that the coaxial cable is led out of the arm through an opening, which is formed in a predetermined position in an end portion of the arm on a side of the primary radiator, its end of the coaxial cable is connected to the coaxial connector, and the coaxial connector is attached to the primary radiator with a right angle to the direction of the arm.

19. A reflector antenna comprising:

a reflector, the reflector having a circular antenna aperture configured as an antenna opening with a radius (r), and a reflecting surface configured to reflect radio waves, the reflecting surface curved to a paraboloid of revolution;

a primary radiator on a focus side of the reflector, the primary radiator arranged to radiate a radio wave (Rd) toward the reflecting surface;

an arm supporting the primary radiator, the arm being rotatable so that the primary radiator is rotatable with respect to the reflector about a rotation axis (Ax) of the paraboloid of the reflector, the arm extending from a vertex side to the focus side of the reflecting surface so as to circumvent the rotation axis Ax of the paraboloid of the reflector; and a feed unit attached to the arm, the feed unit feeding the primary radiator via the arm so that the direction of the arm and the direction of polarization of the radio wave radiated from the primary radiator are perpendicular to each other, wherein, when the arm is situated in parallel with a vertical plane, in a plane parallel to a vertical axis that passes the rotation axis Ax, the feed unit feeds the primary radiator via the arm along a direction (D2) perpendicular to the vertical plane, in a direction parallel to a horizontal axis h that passes the rotation axis (Ax), so that a horizontally-polarized radio wave in the direction of polarization (D1) is radiated from the primary radiator, and when the arm is situated in parallel with a horizontal plane, in a plane parallel to a horizontal axis h that passes the rotation axis (Ax), the feed unit feeds the primary radiator via the arm along a direction (D4) perpendicular to the horizontal plane, in a direction parallel to a vertical axis that passes the rotation axis (Ax), so that a vertically-polarized radio wave in the direction of polarization (D3) is radiated from the primary radiator, the feed unit includes a cable feeding the primary radiator with electric power, and a connector that connects the cable to the primary radiator, the connector connecting the cable to the primary radiator with the direction of feeding from the cable to the primary radiator and the direction of the arm are at right angles to each other.

20. A reflector antenna comprising:

a reflector, the reflector having a circular antenna aperture configured as an antenna opening with a reflecting surface configured to reflect radio waves, the reflecting surface curved to a paraboloid of revolution;

a primary radiator on a focus side of the reflector, the primary radiator arranged to radiate a radio wave (Rd) toward the reflecting surface;

a rotatable arm supporting the primary radiator, the arm rotatable to rotate the primary radiator with respect to the reflector about a rotation axis (Ax) of the paraboloid of the reflector; and a feed unit attached to the arm, the feed unit feeding the primary radiator via the arm where the direction of the arm and the direction of polarization of the radio wave radiated from the primary radiator are perpendicular to each other, wherein, when the arm is situated in parallel with a vertical plane, the feed unit feeds the primary radiator via the arm along a direction (D2) perpendicular to the vertical plane so that a horizontally-polarized radio wave in the direction of polarization (D1) is radiated from the primary radiator, and when the arm is situated in parallel with a horizontal plane the feed unit feeds the primary radiator via the arm along a direction (D4) perpendicular to the horizontal plane so that a vertically-polarized radio wave in the direction of polarization (D3) is radiated from the primary radiator.

* * * * *